US009464449B1

(12) United States Patent
Barcatta

(10) Patent No.: US 9,464,449 B1
(45) Date of Patent: Oct. 11, 2016

(54) ELECTRIC LADDER

(71) Applicant: Frank August Barcatta, Fallbrook, CA (US)

(72) Inventor: Frank August Barcatta, Fallbrook, CA (US)

( * ) Notice: Subject to any disclaimer, the term of this patent is extended or adjusted under 35 U.S.C. 154(b) by 0 days.

(21) Appl. No.: 14/882,938

(22) Filed: Oct. 14, 2015

(51) Int. Cl.
*E04G 1/20* (2006.01)
*E04G 5/14* (2006.01)

(52) U.S. Cl.
CPC .. *E04G 1/20* (2013.01); *E04G 5/14* (2013.01)

(58) Field of Classification Search
CPC ..... E06C 7/16; E04G 5/14
See application file for complete search history.

(56) References Cited

U.S. PATENT DOCUMENTS 107,225 A * 9/1870 Clafin ..... E06C 7/16 182/103
812,620 A * 2/1906 Alstine ..... E06C 7/16 182/121
2,588,959 A * 3/1952 Campbell ..... B66B 9/187 182/103
2,981,374 A * 4/1961 Holsclaw ..... B62B 1/14 187/231
3,052,323 A * 9/1962 Hopfeld ..... B62B 1/14 187/231
3,196,981 A * 7/1965 Winnall ..... E06C 1/22 182/116
3,430,734 A * 3/1969 Embree ..... A01D 46/20 182/103
3,476,212 A * 11/1969 Eakins ..... E06C 7/16 182/103
3,799,289 A * 3/1974 Cecere, Jr. ..... E06C 7/12 182/103
4,049,081 A * 9/1977 McDonald ..... E06C 7/12 182/103
4,100,998 A * 7/1978 Marquez ..... E06C 7/16 182/116
4,258,826 A * 3/1981 Murray ..... B62B 1/002 182/103
4,909,351 A * 3/1990 Johnson ..... E06C 7/16 182/121
5,115,162 A * 5/1992 Leonard ..... B60T 7/042 303/DIG. 3
6,244,381 B1 * 6/2001 Ruble ..... B66B 9/187 182/103
6,533,070 B1 * 3/2003 Elrod ..... E06C 1/345 182/103
7,424,932 B1 * 9/2008 Murphy ..... E06C 1/345 182/103
7,900,745 B1 * 3/2011 Tindal ..... E06C 7/16 182/103
8,011,473 B1 * 9/2011 Gregersen ..... E06C 1/16 182/101
2006/0277848 A1 * 12/2006 Penn ..... E04F 11/064 52/182
2007/0095611 A1 * 5/2007 Oertwig ..... A01M 31/02 182/142
2007/0267250 A1 * 11/2007 Wolff ..... E06C 7/081 182/103
2009/0229914 A1 * 9/2009 Liles ..... E06C 1/10 182/63.1

* cited by examiner

*Primary Examiner* — Katherine Mitchell
*Assistant Examiner* — Candace L Bradford

(57) ABSTRACT

This invention is an electric ladder. It is like no other ladder you have ever seen. It has no rungs or steps but instead has a spacious work platform which traverses up or down at the command of the operator. It is powered by a rechargeable battery feeding an electric motor. The direction of rotation of the motor acting through a series of pulleys and cables moves the platform up or down. Fabricated from high strength graphite composites and utilizing the latest technology in batteries and small high output motors it is lightweight and easily portable for home or professional use.

1 Claim, 21 Drawing Sheets

ELECTRIC LADDER

BACKGROUND

Many people are reluctant to work on ladders, especially when it is more than a few rungs up. They feel insecure. Also, the available space atop a ladder for the tools and materials to do a job is limited. Even the step ladders with a fold down trays have only a small space available. I personally do not like to work on ladders. There is a lot of climbing up and down to get the right tool or the sealant or retrieving the screw that fell down or whatever. I cling to the ladder and worry, for example, that when I pull out a nail I will fall backward when it releases.

Accidents and deaths from falling off of ladders are more prevalent than one might imagine. The Center for Disease Control reported in their weekly Morbidity and Mortality Report (MMWR) of Apr. 25, 2011 (titled "Occupational Ladder Fall Injuries-United States, 2011) that "falls remain a leading cause of unintentional injury/mortality nationwide, and 43% of fatal falls in the last decade have involved a ladder. Among construction workers, an estimated 81% of fall injuries treated in U.S. emergency departments (EDs) involve a ladder." There is clearly the need for a safer way to access work areas that are too high to reach normally. One day when I was studying the rust stain on an outside wall that was caused by rust in a second story window, I thought to myself, "Never in a million years will I climb up there on a ladder and clean that up". That's when I realized that I could invent/build an electric ladder with a platform that would carry me and my tools up there where I could work comfortably and with a feeling of security. The current technology in small high power motors, new improved batteries with higher capacities, and improved high strength composite materials now make it feasible to construct an extremely practical battery powered electric ladder for home or professional use.

SUMMARY

The Electric Ladder described in this specification is both safe and user friendly. It allows one to work comfortably and securely at moderate to extreme heights. Fabricated from high strength graphite composites and utilizing the latest technology in batteries and small high output motors, the ladder is lightweight and easily portable for home or field use. A platform, riding on wheels which are supported on either side by structural tubes, moves up or down based on input from the operator. Safety items include a restraining tube around the operator and switches and brakes to limit the travel of the platform. Margins of safety on the structural elements far exceed basic requirements. The platform is sized to accommodate both the operator and his hand tools.

FIGURES

Figure 6:
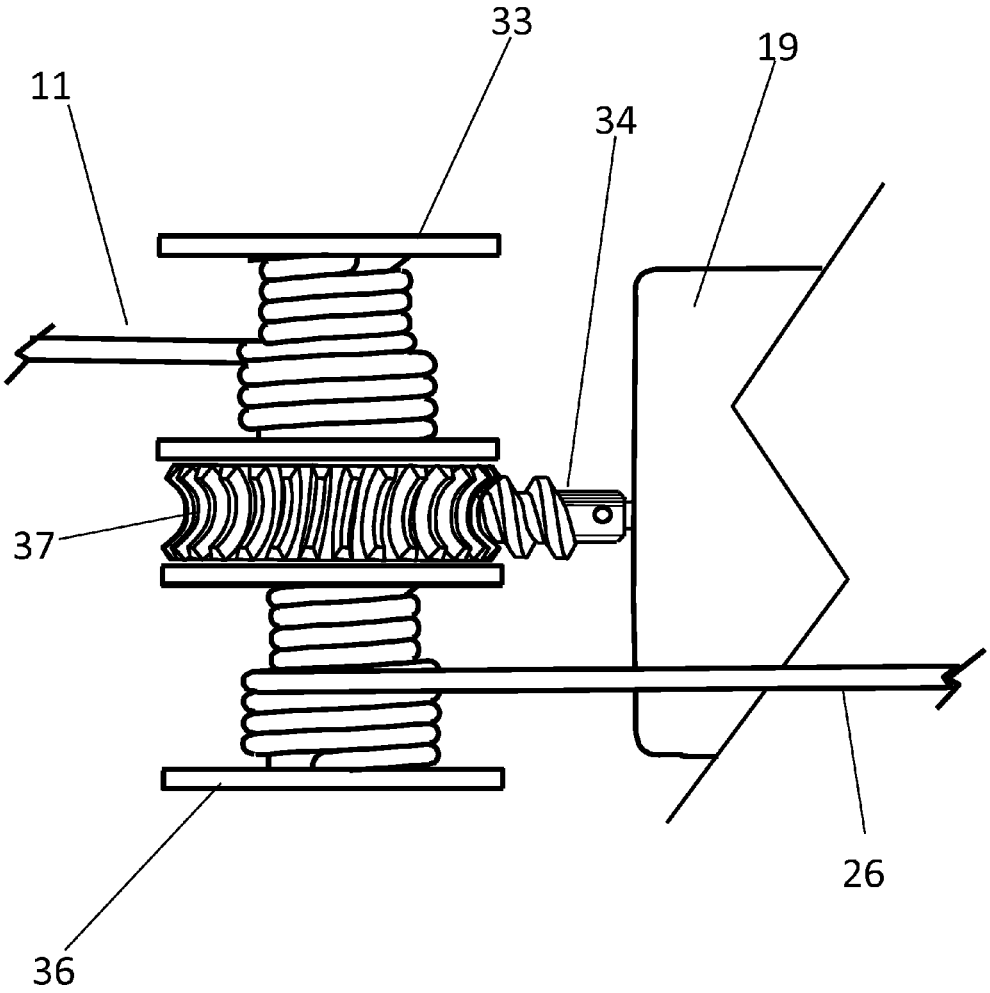

FIG. 6 provides further details of the worm and the worm gear and the winding of the cable on the spools.

Figure 7A:
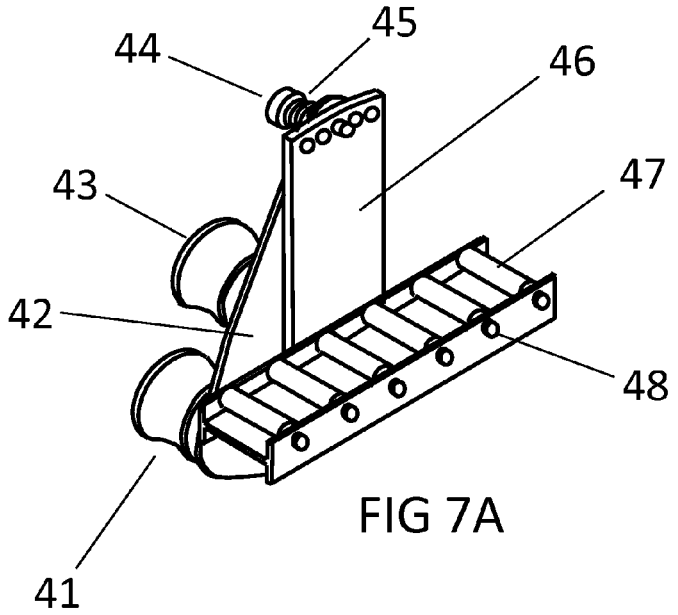

FIG. 7A depicts the left middle sub assembly.

Figure 7B:
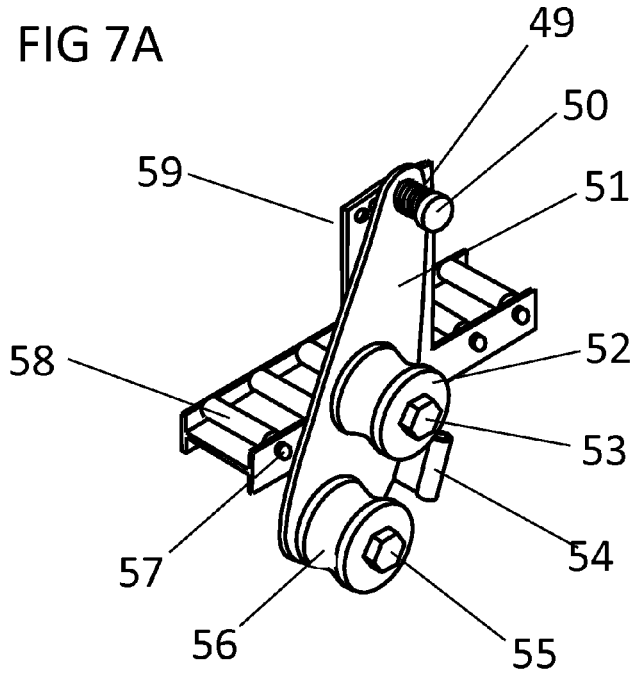

FIG. 7*b* depicts the right middle sub assembly.

Figure 8:
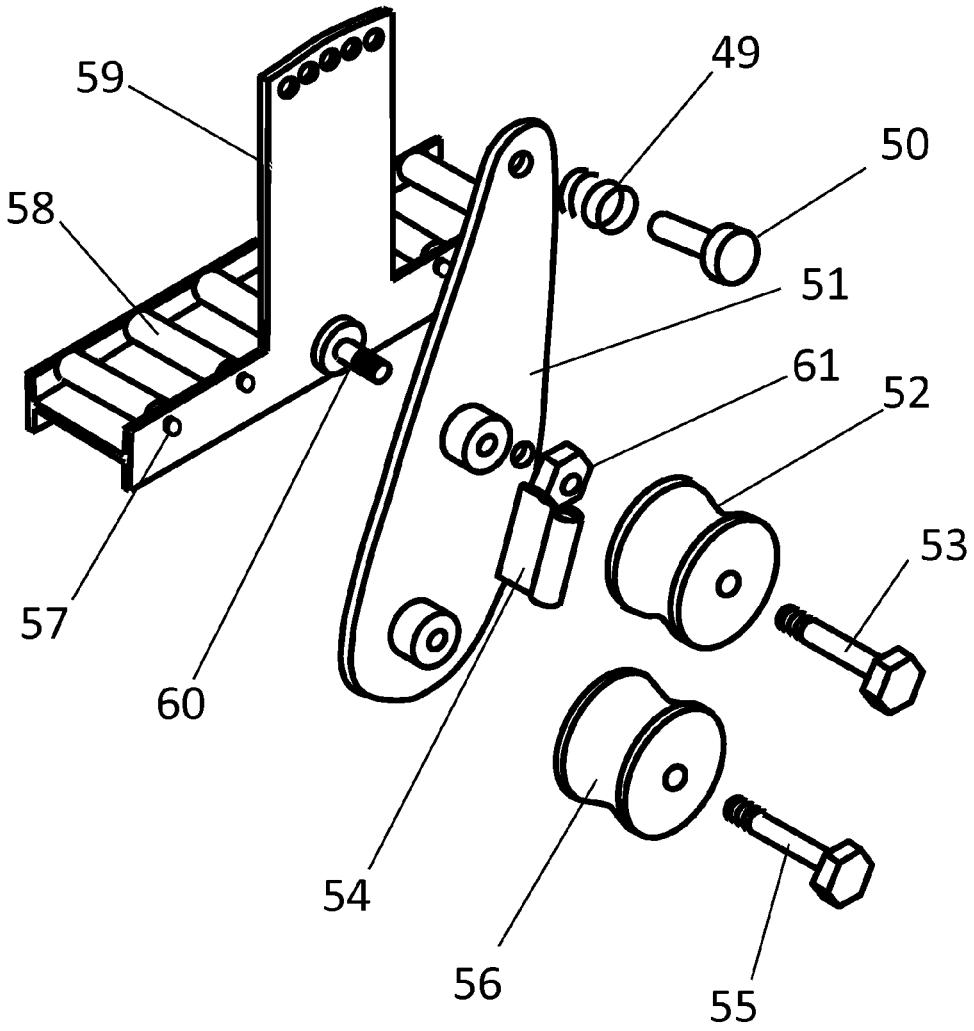

FIG. 8 is an exploded view of the right middle sub assembly.

Figure 9:
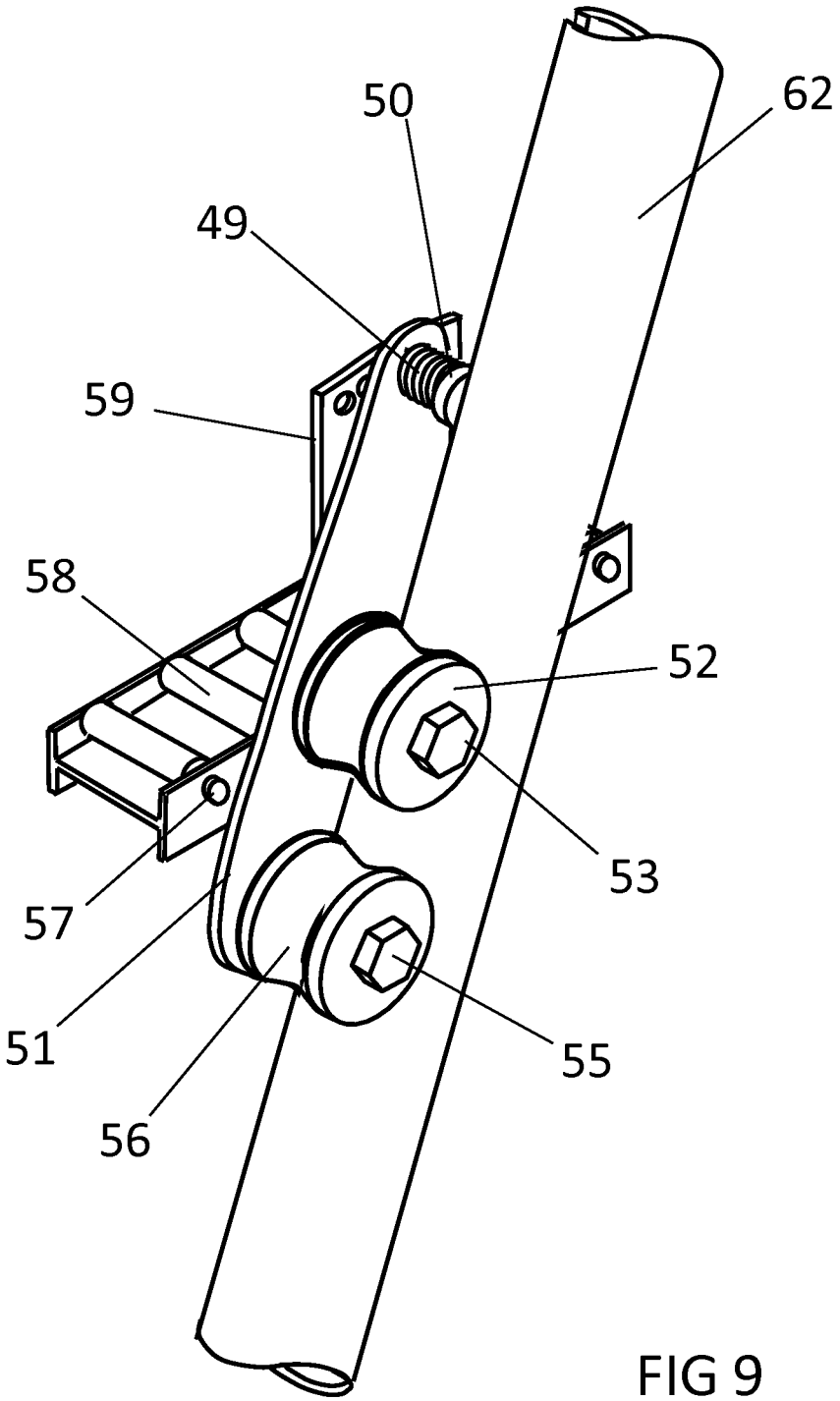

FIG. 9 shows how the wheels ride on top of the support tube.

Figure 10:
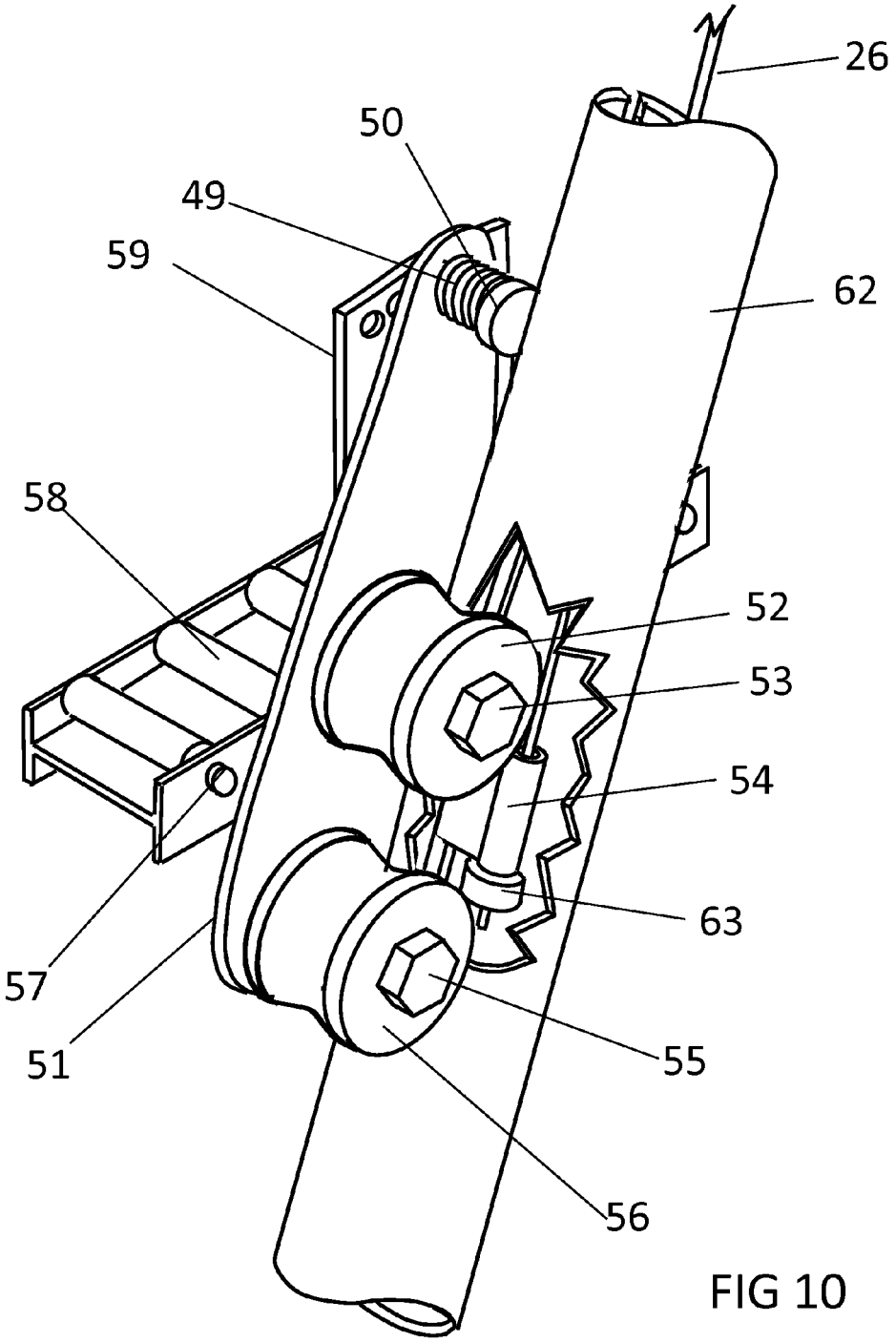

FIG. 10 is a cut-away view showing how the tang rides inside of the support tube and also provides details of the attachment of the cable.

Figure 11:
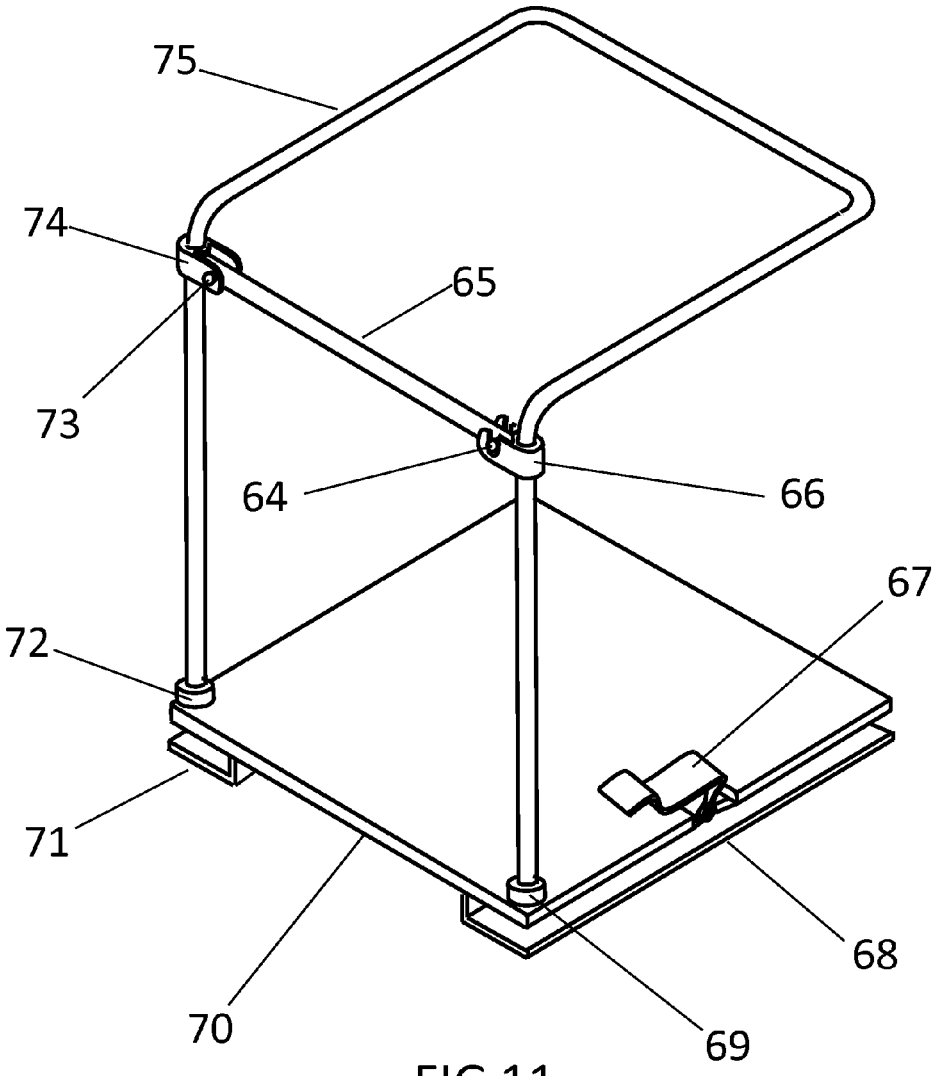

FIG. 11 is an overall view of the platform assembly.

Figure 12:
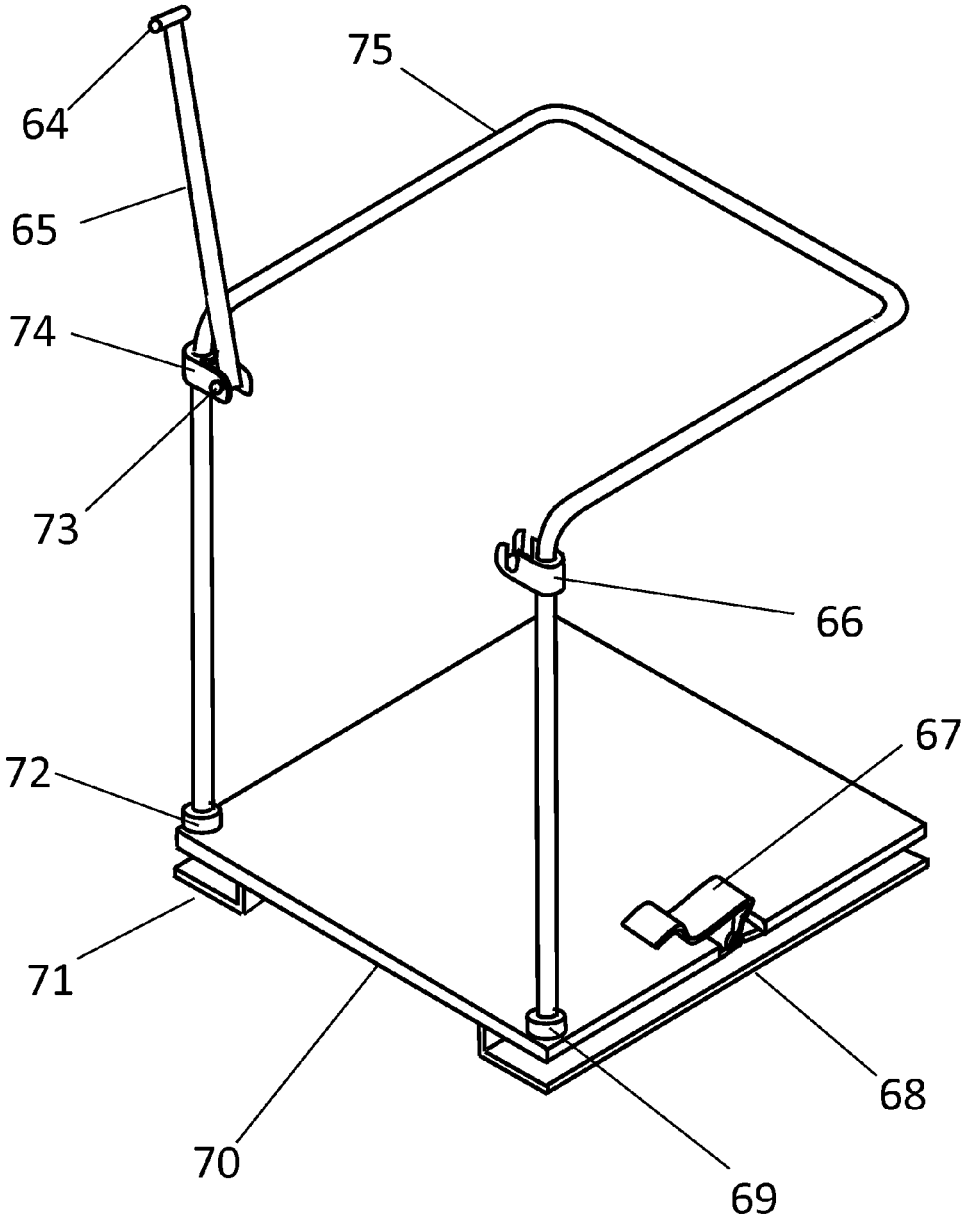

FIG. 12 is the same view of the platform assembly—but with the gate open.

Figure 13:
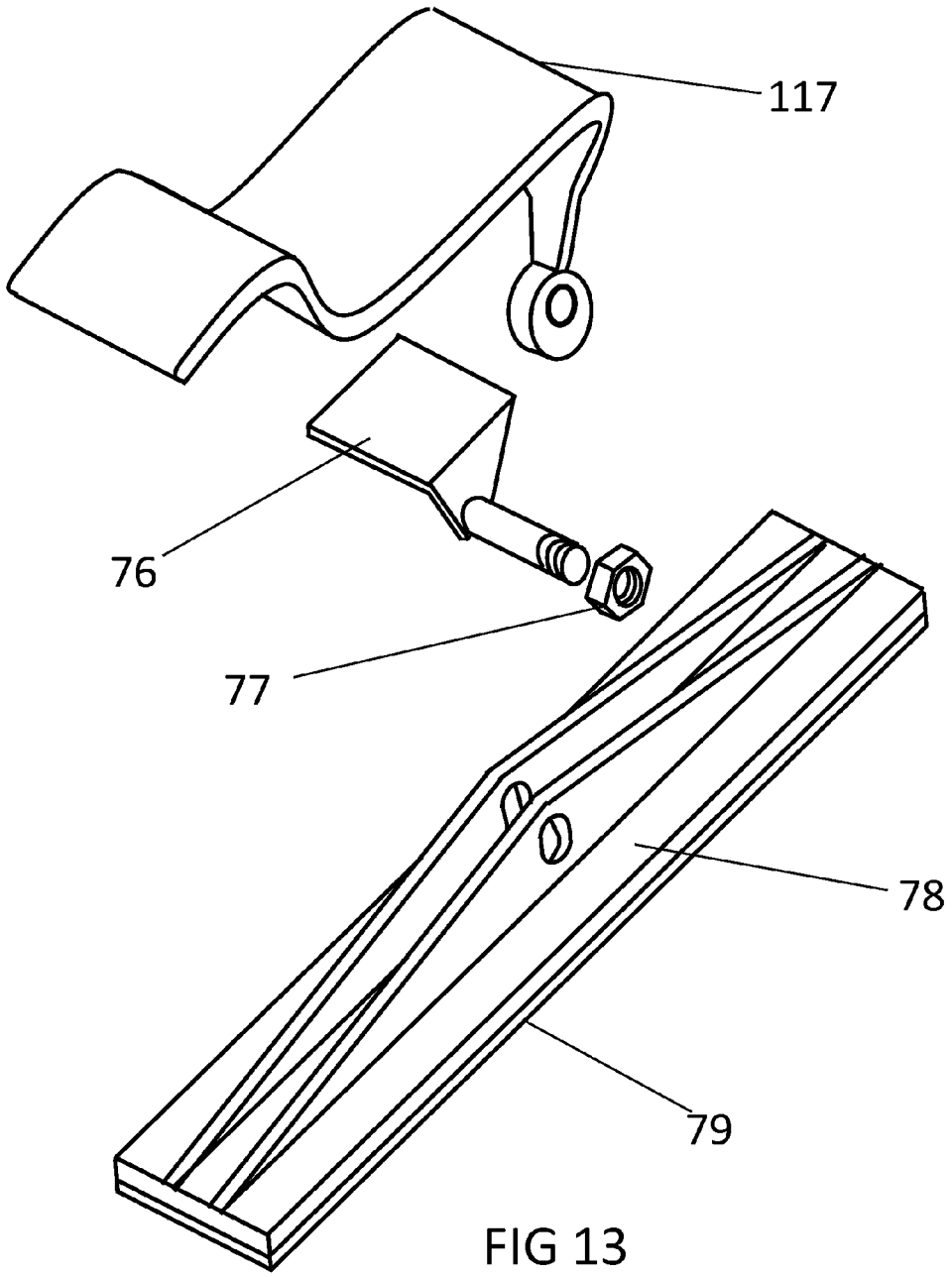

FIG. 13 is an exploded view of the brake assembly.

Figure 14B:
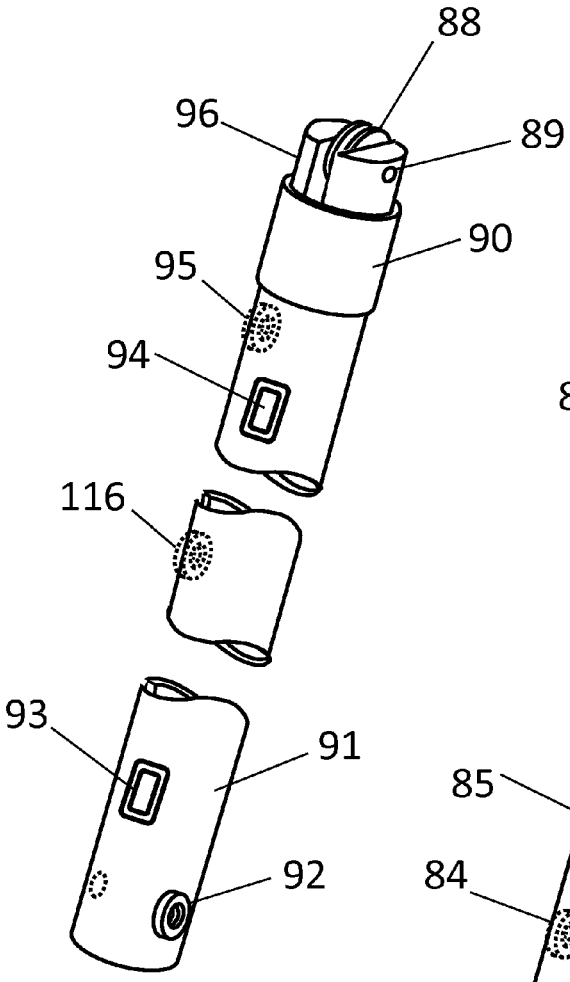
Figure 14A:
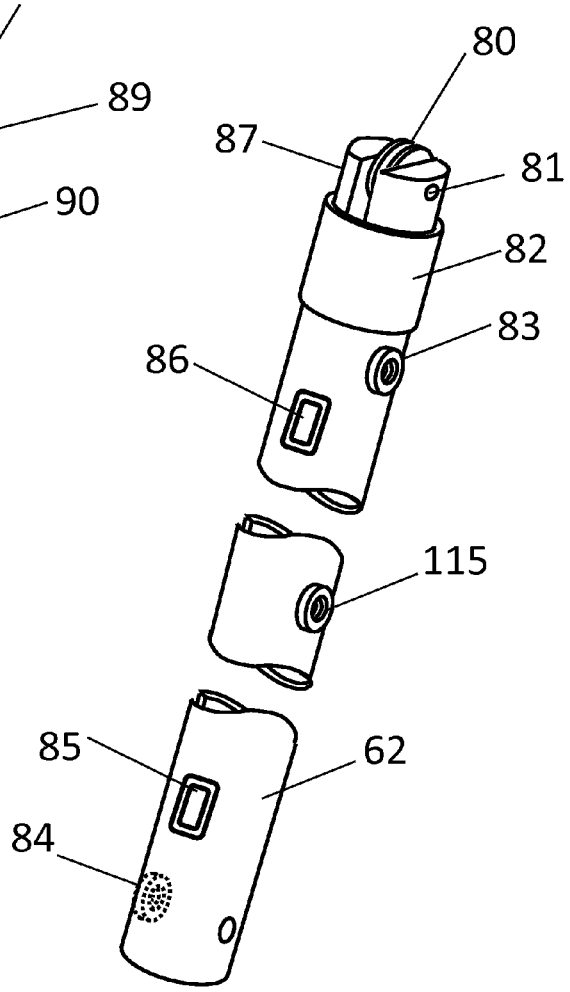

FIG. 14A provides the details of the left support tube.

FIG. 14B provides the details of the right support tube.

Figure 15:
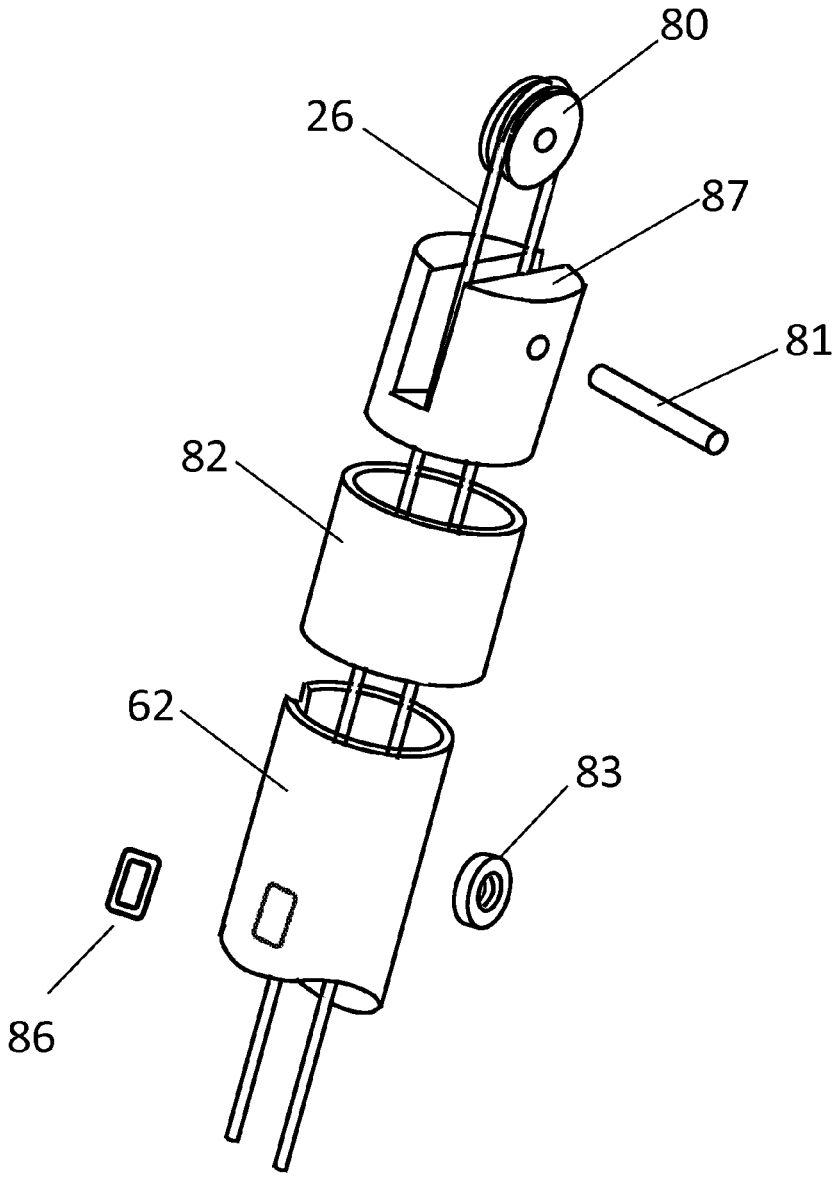

FIG. 15 shows assembly details of the top of the right support tube.

Figure 16:
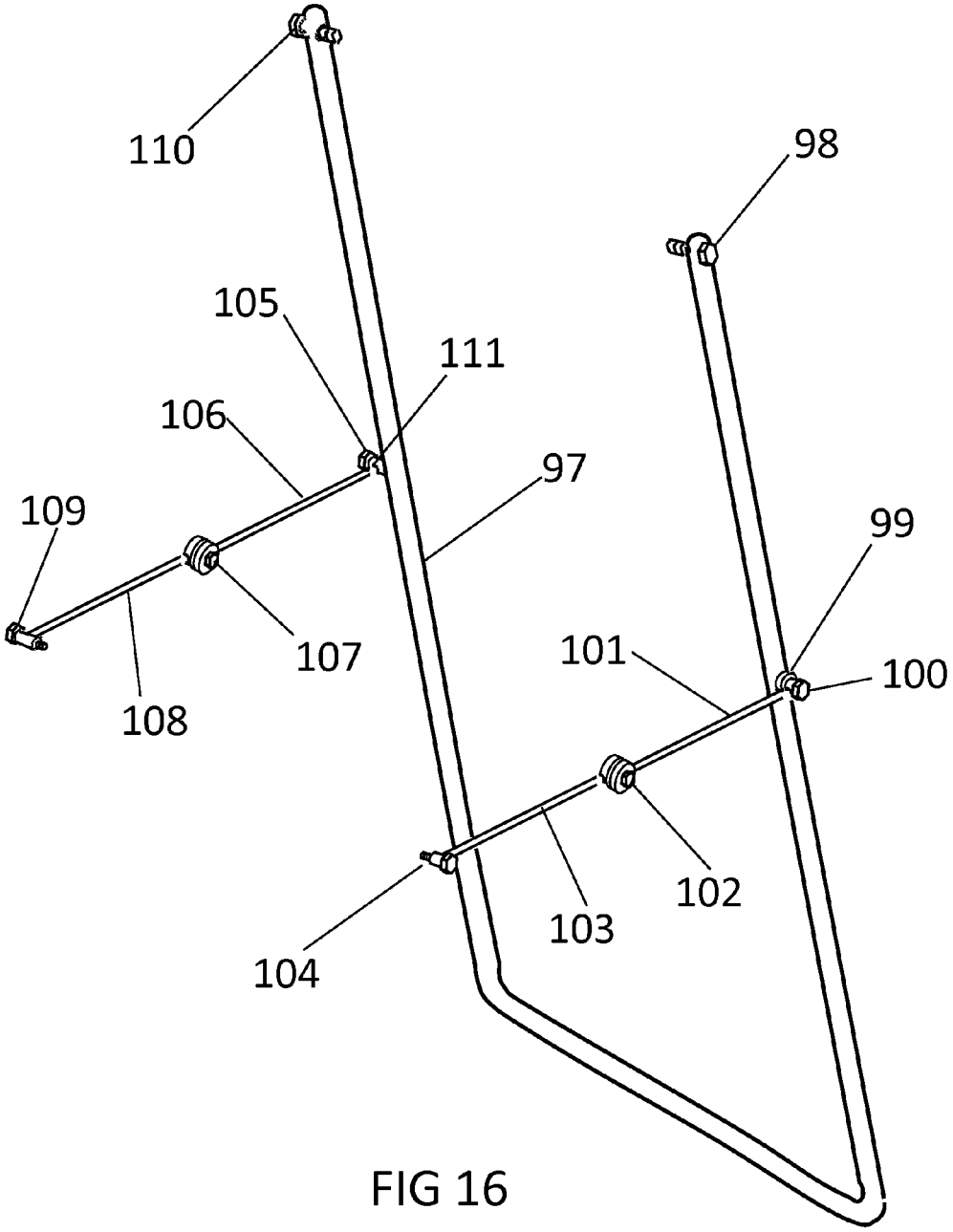

FIG. 16 is an overall view of the rear support assembly.

Figure 17B:
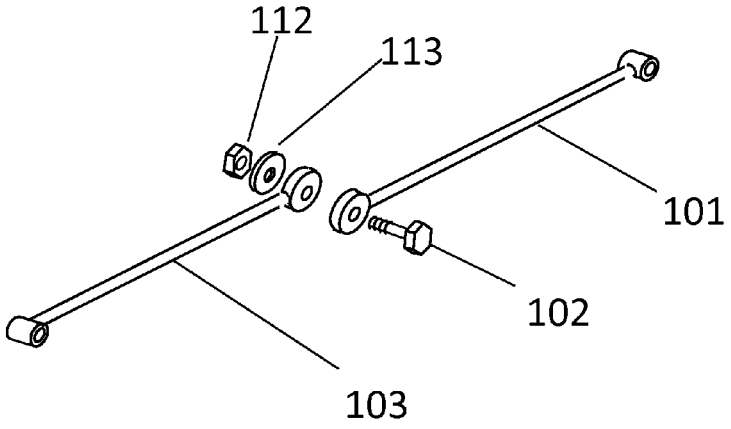
Figure 17A:
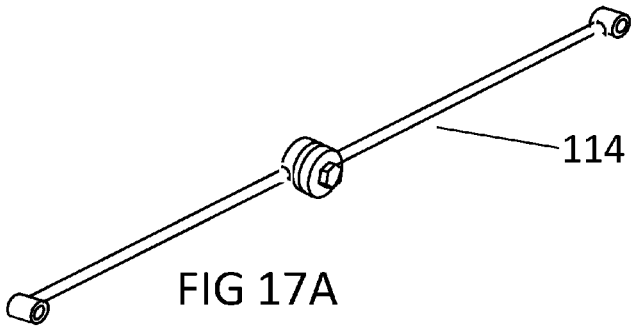

FIG. 17A is an assembled arm.

FIG. 17B provides details of one arm of the rear support assembly.

Figure 17C:
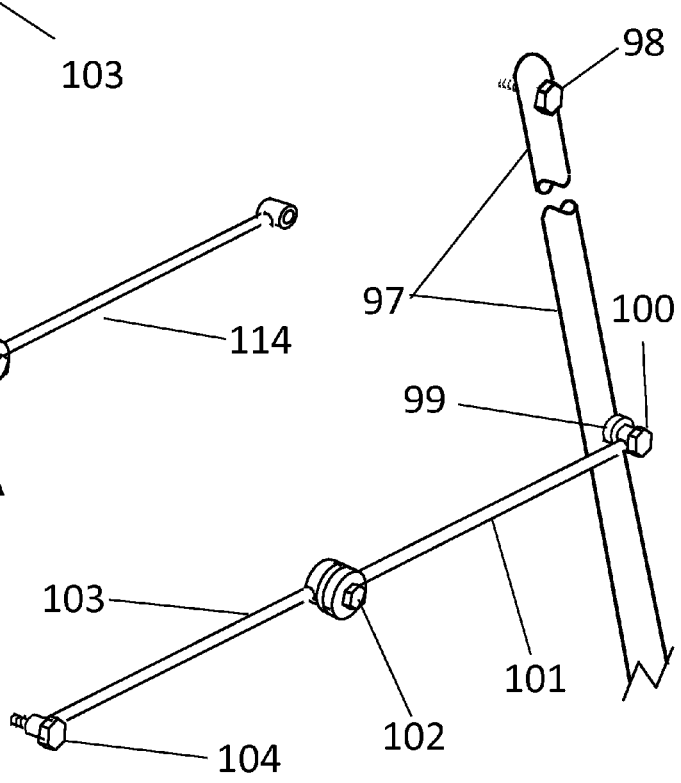

FIG. 17C shows the arm attached to the rear support tube.

Figure 18:
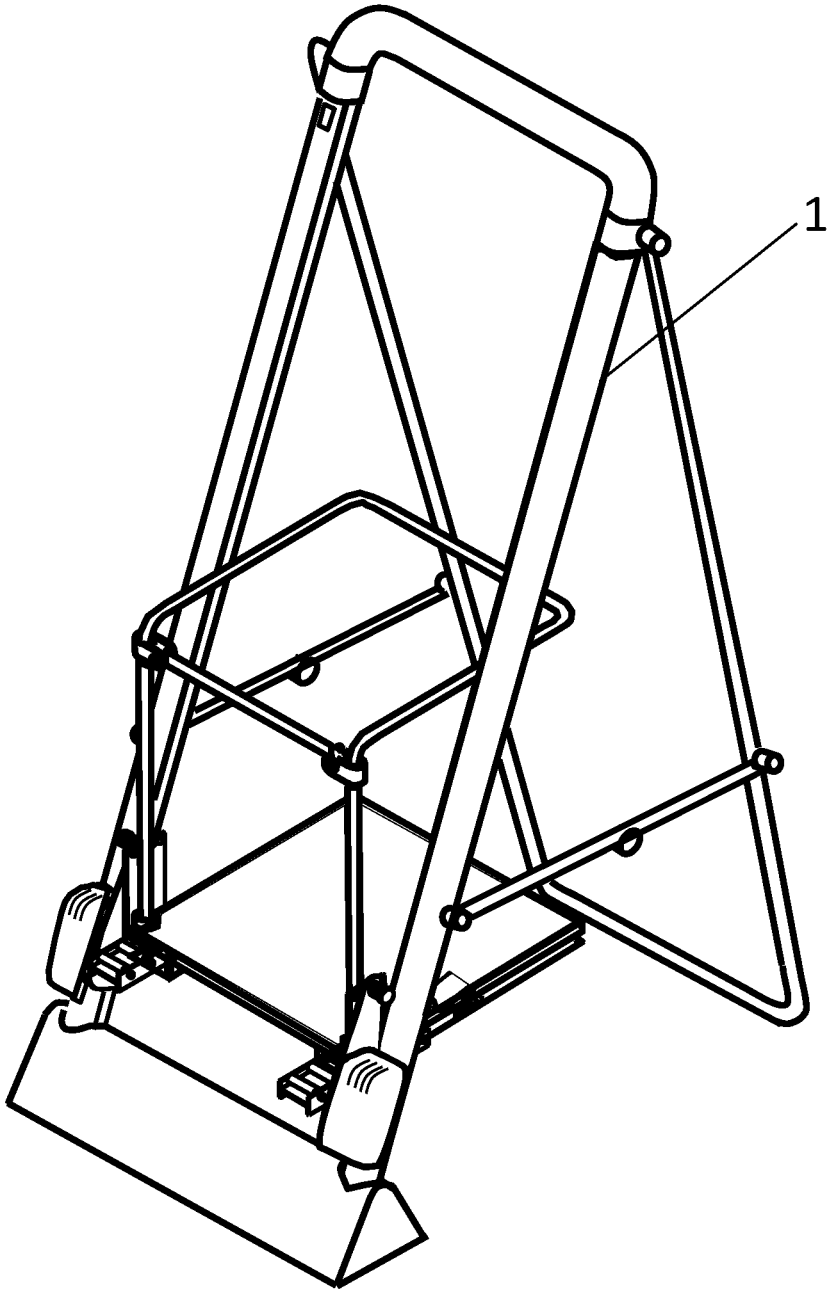

FIG. 18 is a ladder view with platform in extreme lower forward position.

Figure 19:
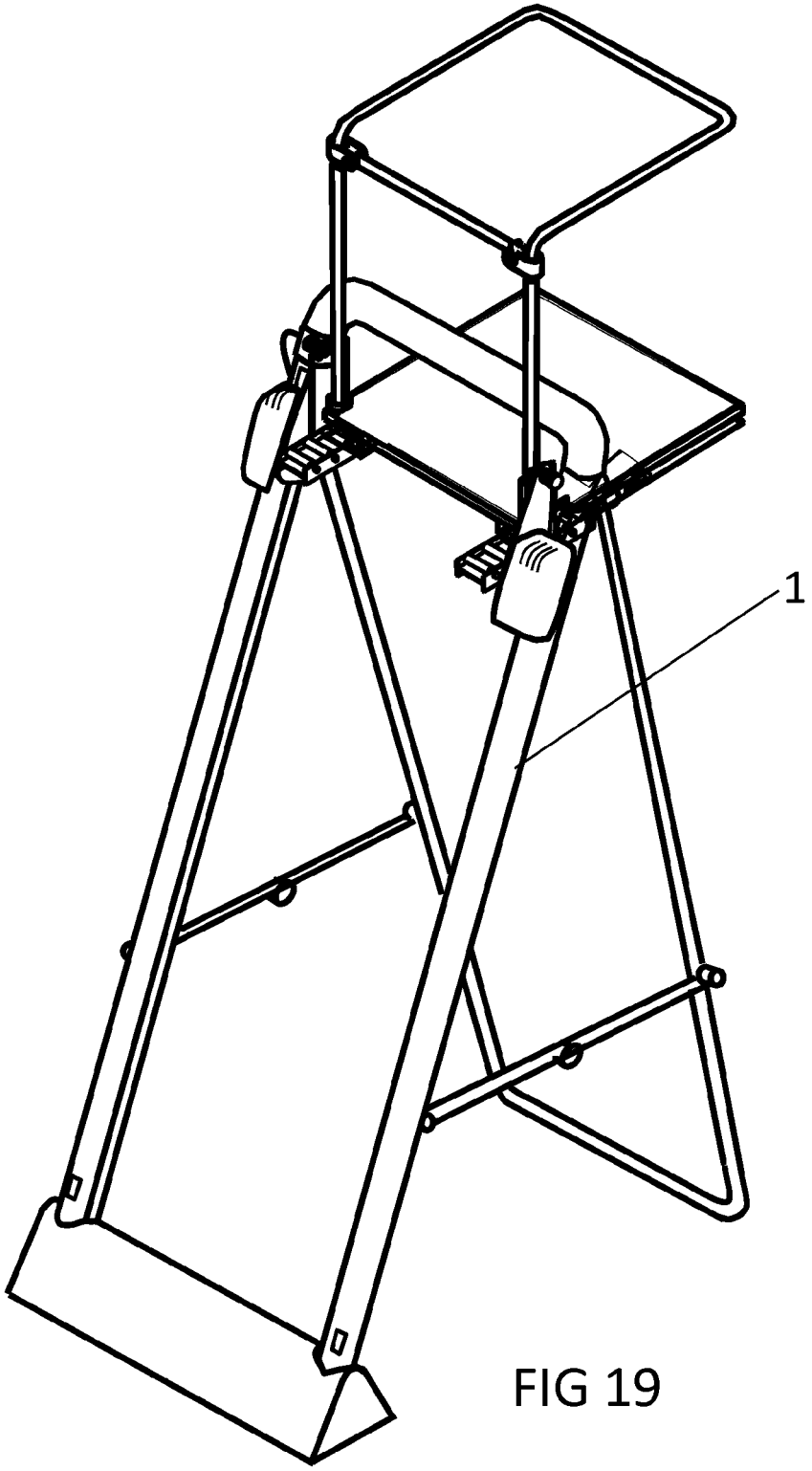

FIG. 19 is a ladder view with platform in extreme upper forward position.

Figure 20:
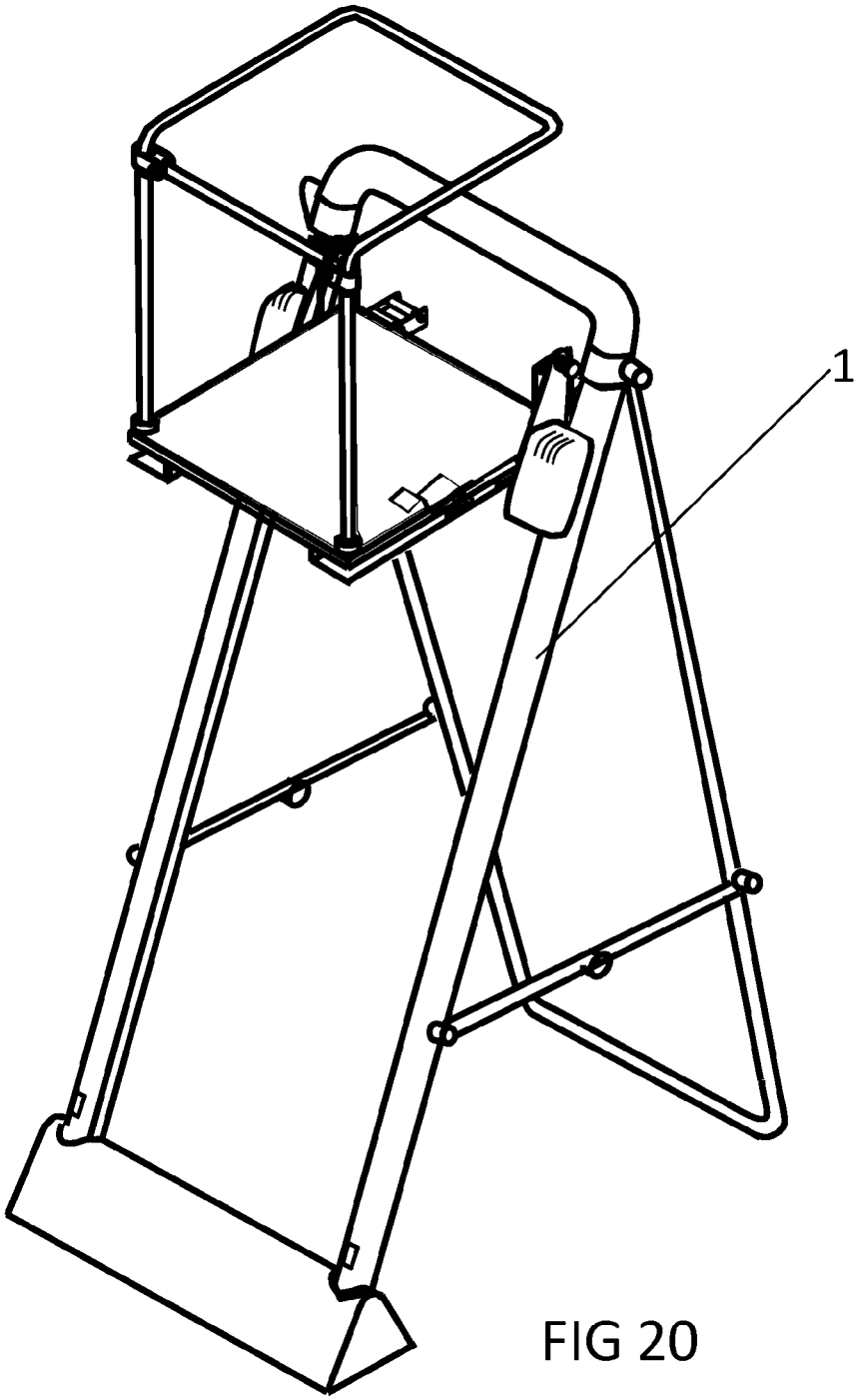

FIG. 20 is a ladder view with platform in extreme upper rearward position.

Figure 21:
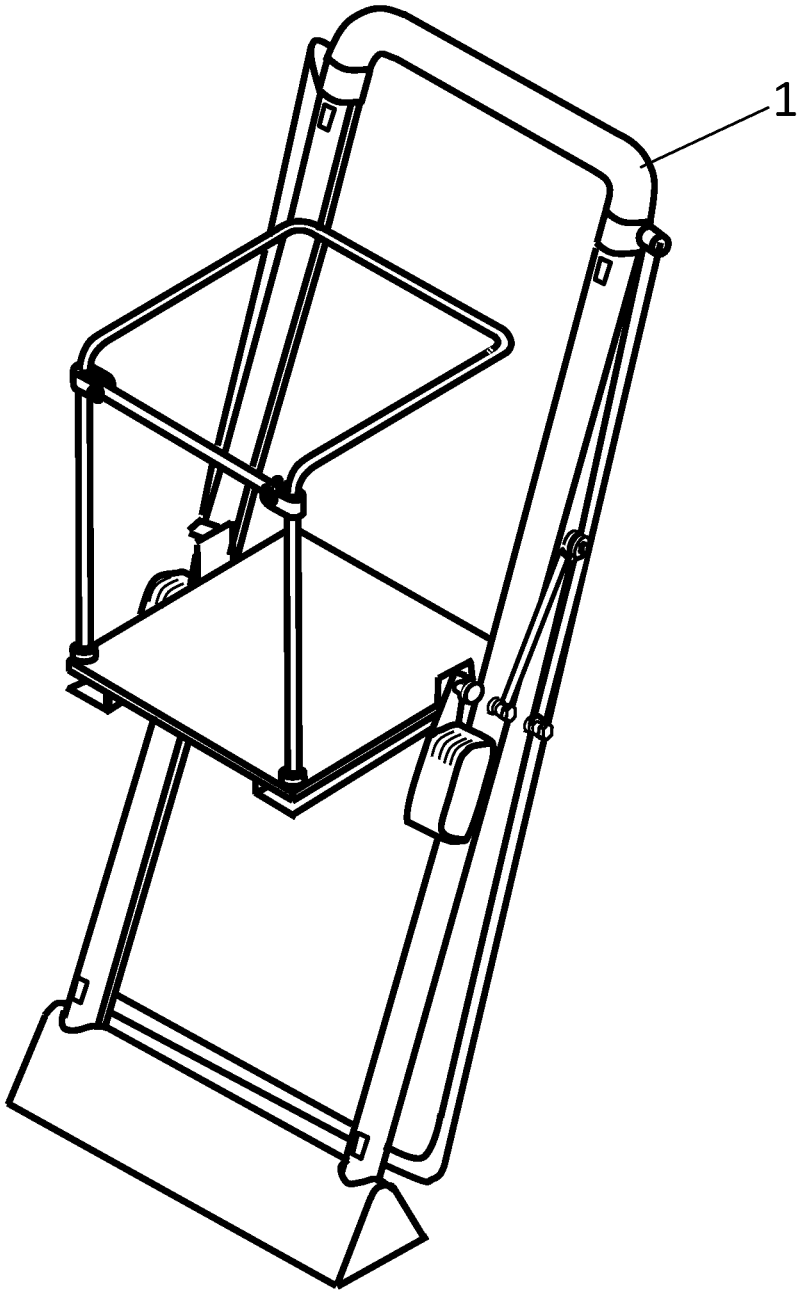

FIG. 21 shows the ladder folded.

DESCRIPTION

General Description

The Electric Ladder described in this specification is vastly different from the ladders that one would see in a typical hardware store. Instead of rungs or steps that are a normal part of a conventional ladder, the Electric Ladder has a platform which moves up or down at the operator's discretion. The platform provides a secure and spacious work area at heights that would be uncomfortable for the operator using a conventional ladder. The platform can be moved forward or backward to get closer to or further from the work area and also can be tilted to accommodate a non level ground surface or an other than normal tilt of the ladder. A restraining tube is mounted to the platform. It provides security for the operator and also provides a means for supporting tools and supplies. The Electric Ladder is powered with a compact and efficient DC motor in combination with a high efficiency state of the art battery. The motor drives a reduction gear comprising a worm/worm gear combination. The resultant output rotates a spool assembly to which are spooled the steel cables that move the platform up and down. The steel cables are guided by pulleys which allow the cable to move through the structural support tubes and ultimately attach to the platform. Rotation of the motor in one direction will raise the platform and in the other direction the platform will be lowered. Control of the motor is accomplished through the control electronics where either manual or remote control is available to operate the platform. Safety features include the use of micro switches on the structural support tubes. Activation of these micro switches signals the control electronics to stop the motion of the platform, thereby preventing ove-travel of the platform in either the up or down direction. A low battery cutoff is also incorporated in the control electronics. This feature prevents motion of the platform if there is insufficient charge in the battery to complete a full up and down cycle. Margins of safety on the structural elements and on the rigging elements, the cable and associated pulleys, are more than adequate for any anticipated loads.

DETAILED DESCRIPTION

Figure 1:
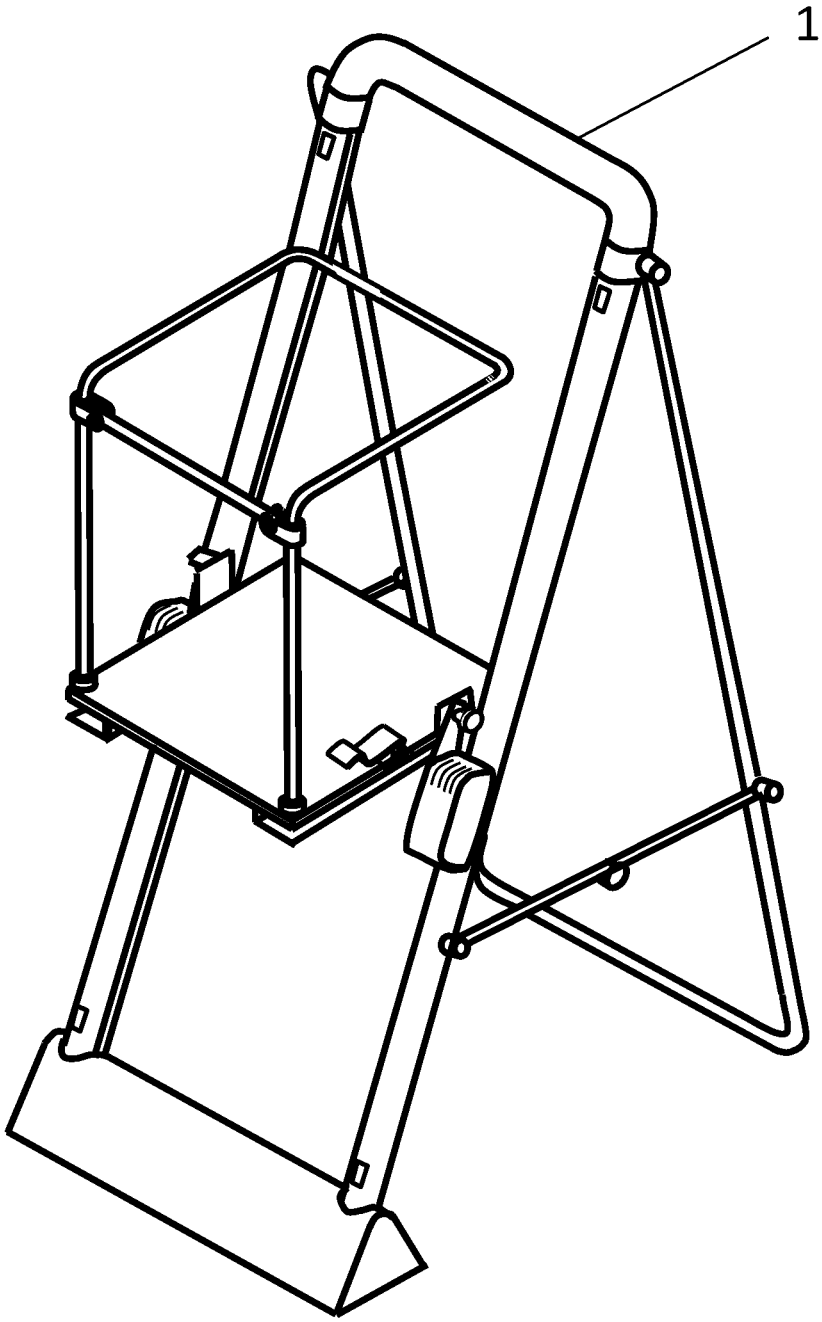
FIG. 1 is a view of the entire Electric Ladder.
Figure 2:
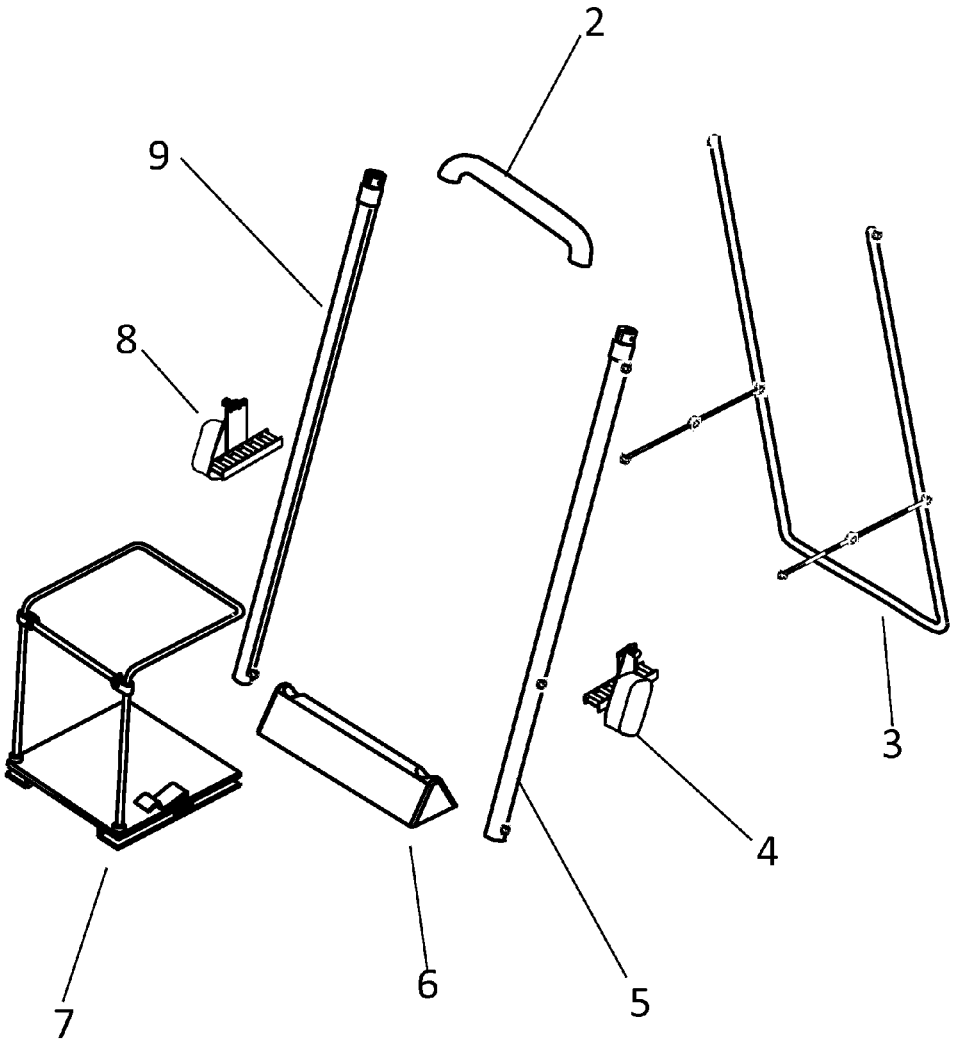
FIG. 2 shows the major sub assemblies of the ladder.

An overall view of the Electric Ladder 1 is depicted in FIG. 1. It comprises eight principal subsystems. These are, as shown in FIG. 2; a Top Bar 2, a Rear Support Assembly 3, the Right Middle Sub Assembly 4, the Right Structural Tube Assy 5, the Base Assembly 6, the Platform Assembly 7, the Left Middle Sub Assembly 8, and the Left Structural Tube Assy 9. Each of these subsystems is discussed in detail in what follows.

Base Assembly

Figure 3A:
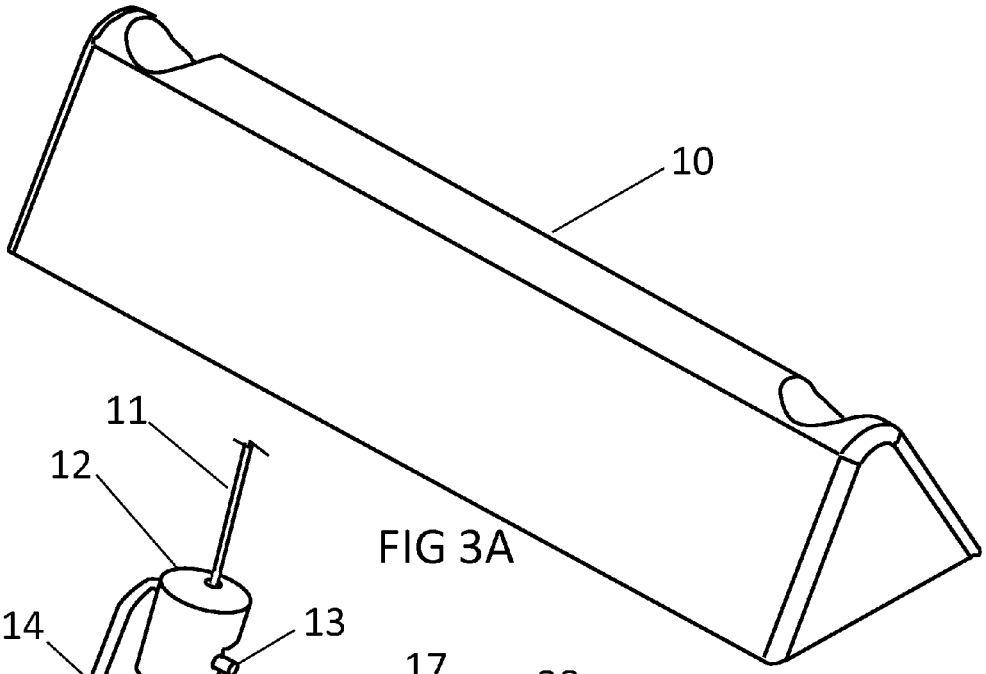
FIG. 3A depicts the cover of the base assembly.
Figure 3B:
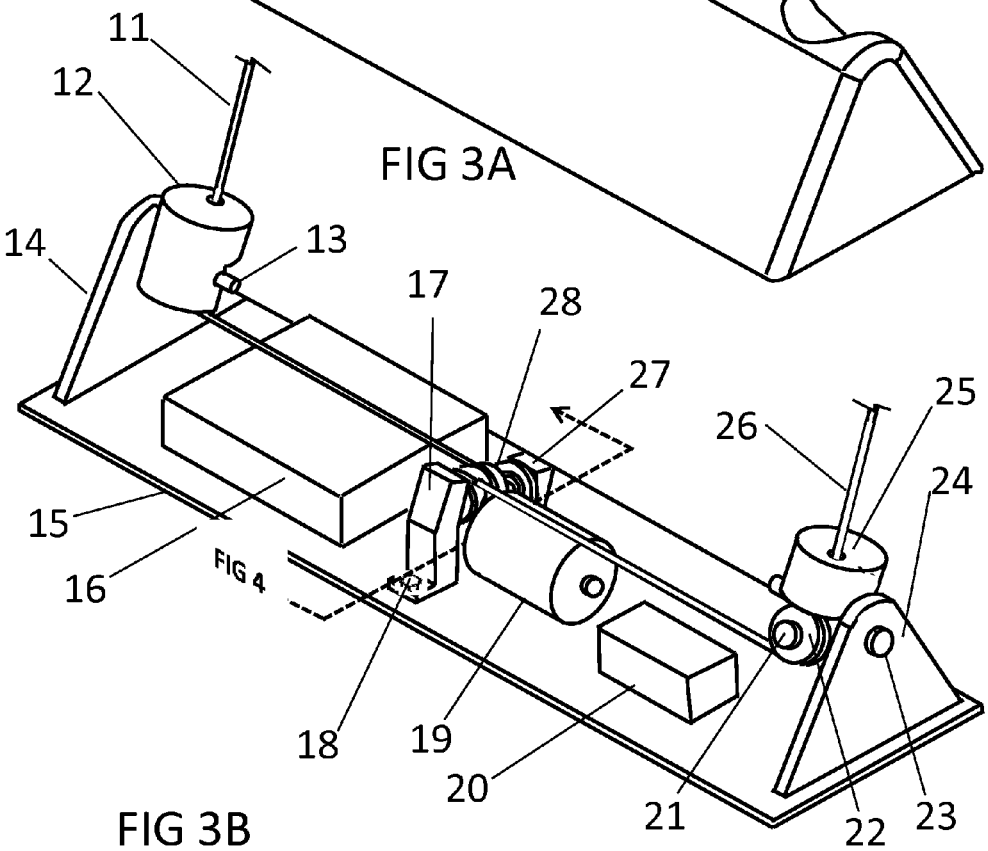
FIG. 3B shows a majority of the items making up the base assembly.

The heart of the Electric Ladder 1, the area which provides the motive power and the control functions to operate the ladder, is within the Base Assembly 6, details of which are shown in FIGS. 3A and 3B. FIG. 3A depicts the Base Cover 10 which is removable to allow for servicing of the items shown in FIG. 3B. The Base Cover 10 is made of plastic composite and acts to protect the enclosed components. The items depicted in FIG. 3B consist of a Base Plate 15 made of metal or high strength composite to which is welded or bonded the Left Support Plate 14 and the Right Support Plate 24 both made of metal or composite as required to match the base plate. The Battery 16, the Dc Motor 19 and the Control Electronics 20 are all mounted to the Base Plate 15 as are the Front Spool Support 17 and the Rear Spool Support 27. On the left side is the Left Lower Pulley Mount 12 which is held in place with the Left Pulley Mount Retainer 13 to the Left Support Plate 14. The Left Pulley Mount Retainer 13 is a steel pin screwed to the back of the Left Support Plate 14 and acts as a bearing surface to allow for rotational motion of the Left Lower Pulley Mount 12. The rotation is necessary to accommodate an other-than-normal angular attitude of the ladder. On the right hand side a similar configuration exists: the Right Lower Pulley Mount 25 held in place with the Right Pulley Mount Retainer 23. Also on the right we see the Right Lower Pulley 22. It is held in place with the Right Lower Pulley Retainer 21. The Left Cable 11 and the Right Cable 26, guided by their respective pulleys, are spooled onto the Spool Sub Assembly 28.

Figure 4:
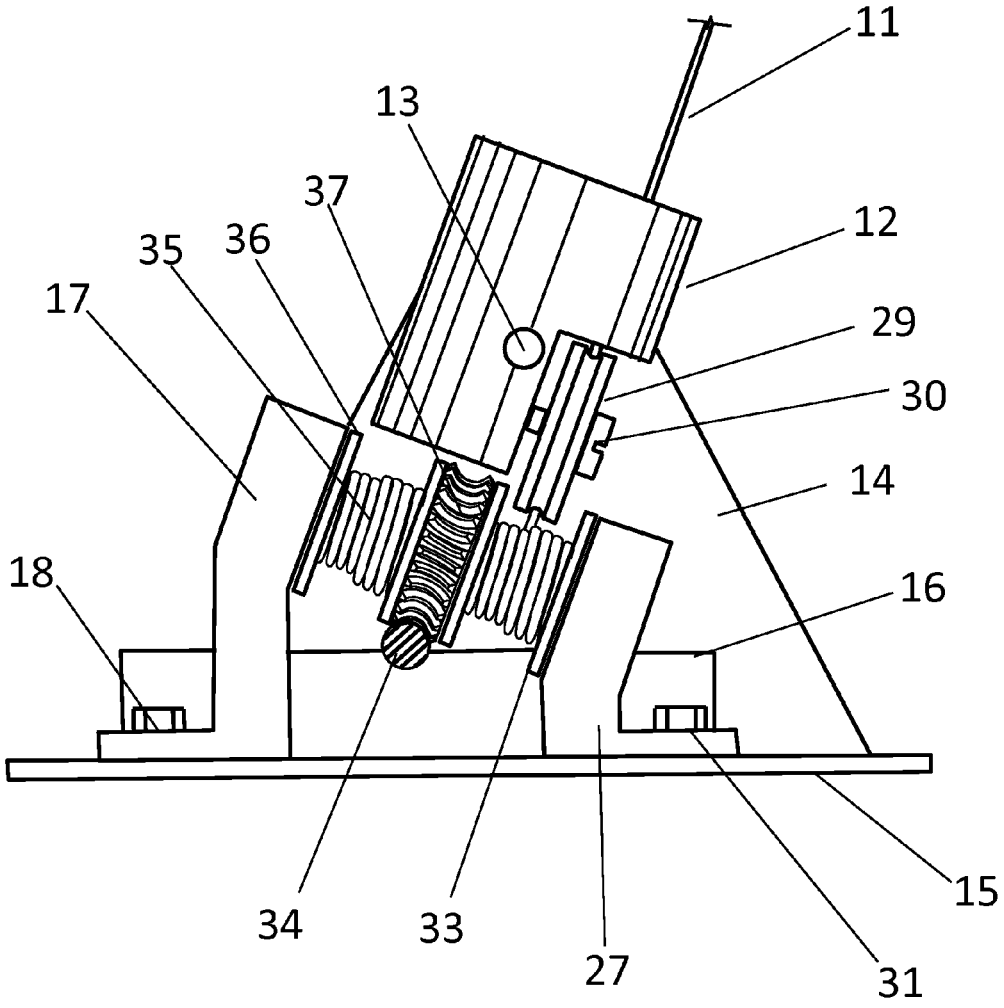
FIG. 4 is a sectional view of the base assembly, looking to the left, from a plane between the motor and the worm gear.
Figure 5:
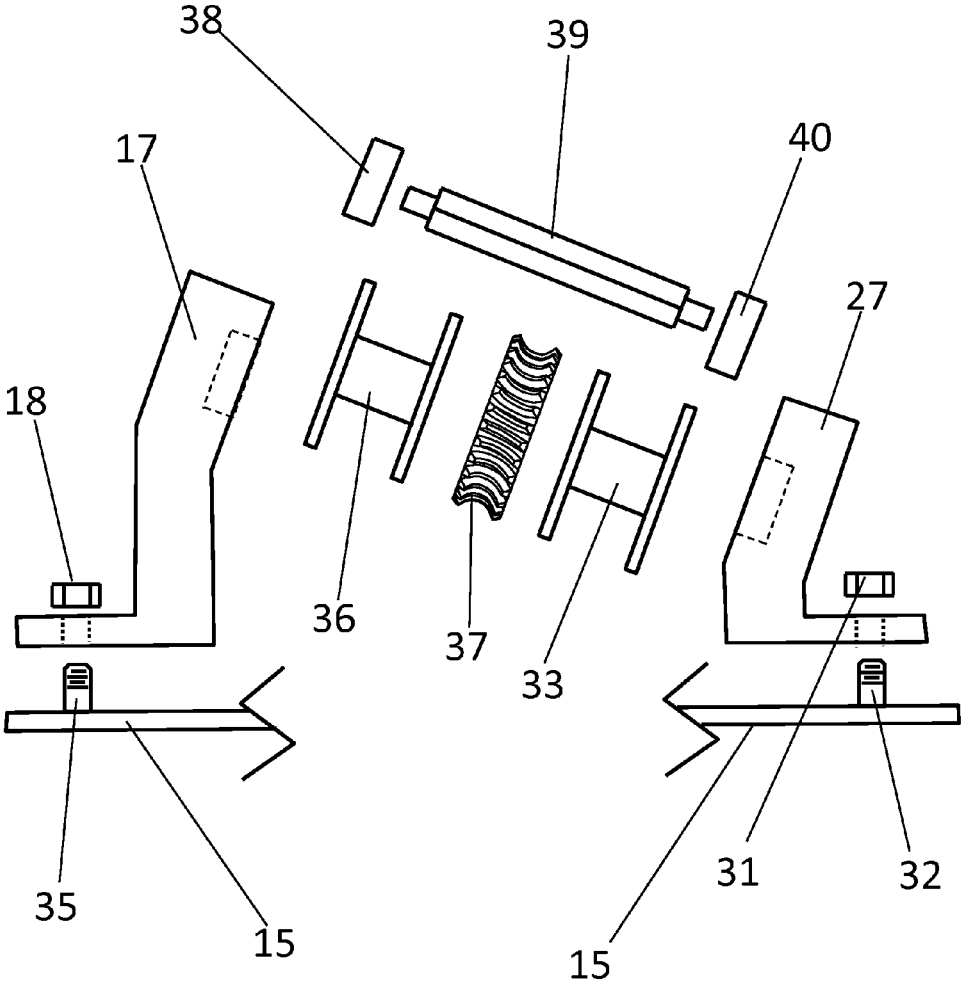
FIG. 5 is an exploded view showing the various elements making up the spool sub assembly and its mounting to the base plate.

A view to the left from the view point at the left side of the Dc Motor 19, as indicated on FIG. 3B, is shown in FIG. 4. Among the new items not previously described are the Left Lower Pulley Retainer 30 and the Left Lower Pulley 29 which guides the Left Cable 11 up through the Left Lower Pulley Mount 12. The Rear Spool Support Nut 31 and the Front Spool Support Nut 18 hold the spool supports in place. There are two spools: the Rear Spool 33 and the Front Spool 36. The steel cables wind and unwind on these spools depending on the rotational direction of the Dc Motor 19. The Front Spool Support Nut 18 and the Rear Spool Support Nut 31 screw onto the Front Stud 35 and the Rear Stud 32, as depicted in FIG. 5, to hold the spool supports in place. Finally the Worm 34 and the Worm Gear 37 are located as shown. FIG. 5 shows how the pieces of the Spool Sub Assembly 28 all fit together.

New items in FIG. 5 not previously identified are the Front Bearing 38, the Rear Bearing 40, the Square Drive Shaft 39, the Rear Base Stud 32 and the Front Base Stud 35. The unit is assembled by inserting the bearings into the bottom drilled holes in the two mounts, then slipping the spools and the worm gear over the square shaft and then inserting it into the bearings, setting the unit over the studs and finally installing the nuts. Square holes through the centers of the spools and gear prevent rotation of any individual element with regard to the whole unit. This configuration provides a near frictionless assembly for spooling the cables. Further insight into the spooling is obtained by viewing the top view of FIG. 6. Here we see the Right Cable 26 winding or unwinding on the top of the Front Spool 36 and the Left Cable 11 winding or unwinding on the bottom of the Rear Spool 33. Rotation of the Spool Sub Assembly 28 plays out cable when rotating in one direction and takes in cable when rotating in the opposite direction, thereby lowering or raising the Platform Assembly 7. There are two very beneficial reasons for using worm/worm gear gearing for this application. The first is size and weight. For a given gear ratio this type of gearing is considerably smaller and lighter than conventional spur gear arrangements. The second, and perhaps more important reason, is that worm/worm gear gearing is self locking. That is to say the output cannot drive the input. In the case of the electric ladder, when power is applied to the drive motor the platform raises or lowers, but when power is removed, the platform remains locked in place.

Middle Sub Assemblys

FIG. 7A and FIG. 7B are drawings of the left and right middle sub assemblies. Wheels, depicted by the identifying numerals 41, 43, 52 and 56 ride on the left and right structural tubes shown in FIG. 2, whose identifying numerals are 9 and 5 respectively. FIG. 9 shows the arrangement. The two sub assemblies are held together and move as one when the Platform Assembly 7, shown in FIG. 2 is installed between them. Starting with FIG. 7A the parts making up the Left Middle Sub Assembly 8 are the Lower Left Wheel 41, the Left Wheel Mounting Plate 42, the Upper Left Wheel 43, the Left Adjuster Knob 44, the Left Spring 45, the Left Adjuster Plate 46, the Left Slide Rollers 47, and the Left Roller Pins 48. On the right side we have the parts as shown in FIG. 7B comprising the Right Spring 49, the Right Adjuster Knob 50, Right Wheel Mounting Plate 51, the Upper Right Wheel 52, the Upper Wheel Mounting Bolt 53, the Tang 54, the Lower Wheel Mounting Bolt 55, the Lower Right Wheel 56, the Right Roller Pins 57, the Right Side Rollers 58, and the Right Adjuster Plate 59. The exploded view of FIG. 8 shows more details of the parts and assembly of the Right Middle Sub Assembly 4. The Left Middle Sub Assembly 8 is just a mirror image; and, therefore, the following discussion applies equally to it. With the exception of the Right Threaded Stud 60 and the Right Nut 61 all of the other parts in this figure have been previously identified. A description of the assembly of the unit and the function of the parts begins with the Right Adjuster Plate 59. It holds the Right Roller Pins 57 which retain the Right Side Rollers 58. The guides in the lower portion of the Platform Assembly 7 slide over the rollers, thereby allowing the platform to move forward and backward easily. A series of holes in the top of the Right Adjuster Plate 59 provide the capability to vary the angle of the plate and thereby vary the angle of the Platform Assembly 7. This capability allows one to level the platform when the base of the ladder is slanted. The Right Spring 49 is welded to the Right Adjuster Knob 50 on one end and on the other end to the Right Wheel Mounting Plate 51. When the unit is assembled, the end of the Right Adjuster Knob 50 protrudes through the Right Wheel Mounting Plate 51 and into one of the top holes.

This then fixes the angle of the platform. The Right Wheel Mounting Plate 51 is affixed to the Right Adjuster Plate 59 by slipping it over the Threaded Stud 60 and installing the Right Nut 61. The wheels are held in place by inserting the two threaded bolts, the Upper Wheel Mounting Bolt 53 and the Lower Wheel Mounting Bolt 55, through the wheels and screwing them into the threaded bosses on the Right Wheel Mounting Plate 51. That completes the assembly of the unit. The Tang 54 plays a key role in the operation of the ladder. It is welded to the mounting plate as shown in FIG. 8 and rides within the Right Structural Tube 62. A slot running the full length of the tube allows the Tang 54 to travel the full length of the tube. It is here at the Tang 54 that the cable is attached that moves the platform up or down. A cut-away view showing the Tang 54 inside the Right Structural Tube 62 is depicted in FIG. 10. The Crimp Fitting 63 is crimped to the end of the Right Cable 26 to secure it and to prevent the cable from passing through the Tang 54. As the cable is drawn up the entire Right Middle Sub Assembly 4 is raised and, conversely, a downward movement of the cable allows the Right Middle Sub Assembly 4 to descend. A complete discussion of the rigging, e.g. the movement of the cable within the entire ladder is discussed later on in this document.

Platform Assembly

The Platform Assembly 7 is shown in FIG. 11. It comprises the Latch Pin 64, the Gate 65, the Latch 66, the Brake Unit 67, the Right Roller Guide 68, the Right Tube Mount 69, the Platform 70 the Left Roller Guide 71, the Left Tube Mount 72, the Gate Hinge Pin 73, the Gate Hinge 74 and the Security Tube 75. The Security Tube 75 is mounted to the Platform 70 by inserting its ends into the Left Tube Mount 72 and the Right Tube Mount 69. The mounts are bonded to the top of the platform. The Gate 65 can be raised to allow access to the platform and lowered to provide security. FIG. 12 depicts the gate in the open position. The final item to discuss as related to the platform assembly is the brake.

The Brake

The function of the brake is to lock the platform in position to prevent it from moving during normal operation of the ladder. The brake is unlocked when the operator wants to move the platform forward or backward. It is placed on the floor of the platform to allow the operator to move it with his foot. FIG. 13, an exploded view of the Brake Unit 67, has the following components: the Brake Pedal 117, the Brake Mount 76, the Brake Nut 77, the Brake Pad 78 and the Elastomeric Pad 79. The Brake Unit 67 resides in a cutout on the right side of the Platform 70 as can be seen in FIG. 11. To assemble the unit the Elastomeric Pad 79 is first bonded to the Brake Pad 78 then the Brake Mount 76 is bonded to the underside of the Platform 70. The Brake Pedal 117 and the Brake Pad 78 are then slid over the shaft on the Brake Mount 76 and retained with the Brake Nut 77. The cam on the end of the Brake Pedal 117 is inserted between the two triangular elements during the assembly. As the pedal is rotated about the shaft the cam presses down, more or less, on the top of the Brake Pad 78. Slotted holes in the triangular elements of the pad allow it to follow the cam position. When locked the pedal is basically in the position shown in FIG. 13. The cam position is such as to put maximum downward pressure on the brake and elastomeric pads and then onto the roller assembly, thereby preventing it from moving. When the operator wants to release the brake he puts his toe under the pedal and flips it up. Pushing down with the foot resets the brake and over rotates the cam slightly, thereby holding the brake in place.

The Structural Support Tubes

FIG. 14A and FIG. 14B are external views of the Right Structural Tube Assy 5 and the Left Structural Tube Assy 9 respectively. On the right hand side the parts are: the Right Structural Tube 62, the Right Upper Pulley 80, the Right Upper Pulley Retainer 81, the Right Sleeve 82, the Right Upper Threaded Boss 83, the Right Lower Threaded Boss 84, the Micro Switch 2 85, the Micro Switch 1 86, the Right Middle Threaded Boss 115 and the Right Upper Pulley Mount 87. The parts for the left hand side are: the Left Upper Pulley 88, the Left Pulley Retainer 89, the Left Sleeve 90, the Left Structural Tube 91, the Left Lower Threaded Boss 92, the Micro Switch 4 93, the Micro Switch 3 94, the Left Upper Threaded Boss 95, the Left Upper Pulley Mount 96 and the Left Middle Threaded Boss 116. The upper portion of the Right Structural Tube Assy 5 is shown as an exploded view in FIG. 15. Item 26 is the Right Cable 26. The other items have already been identified above. Assembly is simple enough. The Right Sleeve 82 is bonded to the tube at the halfway point of the sleeve. The Right Upper Pulley 80 with its Right Upper Pulley Retainer 81 is inserted into the Right Sleeve 82. The Right Upper Threaded Boss 83 is bonded to the tube. It accommodates the Upper Right Bolt 98 of the Rear Support Assembly 3. The Micro Switch 3 94 is snapped into its opening and the electrical wires from the switch are routed inside the tube. During the rigging operation, which is discussed later, the Right Cable 26 is inserted as shown.

Rear Support Assembly

The Rear Support Assembly 3 supports the ladder in an upright posture. Elements of the unit as portrayed in FIG. 16 are the Rear Support Tube 97, the Upper Right Bolt 98, the Middle Right Threaded Boss 99, the Right Rear Bolt 100, the Right Rear Arm 101, the Right Middle Bolt 102, the Right Front Arm 103, the Right Front Bolt 104, the Left Rear Bolt 105, the Left Rear Arm 106, the Left Middle Bolt 107, the Left Front Arm 108, the Left Front Bolt 109, the Upper Left Bolt 110 and the Middle Left Threaded Boss 111. FIG. 17A is a drawing of the Cross Arm Assembly 114, and FIG. 17B is an exploded view of that assembly. Items shown in this view not previously identified are the Middle Bolt Nut 112 and the Spring Washer 113. The Spring Washer 113 when properly compressed by turning the Middle Bolt Nut 112 produces sufficient friction between the two arms to hold them in place. FIG. 17C provides insight about the connection of the Cross Arm Assembly 114 to the Rear Support Tube 97 and the subsequent connections to the Right Structural Tube Assy 5. The Rear Support Tube 97 attaches to the Right Upper Threaded Boss 83 of the Right Structural Tube Assy 5 using the Upper Right Bolt 98. The Right Front Bolt 104 screws into the Right Middle Threaded Boss 115 of the Right Structural Tube Assy 5.

Top Bar

The Top Bar 2 provides a fixed separator for the top of the Right Structural Tube Assy 5 and the Left Structural Tube Assy 9 (reference FIG. 2). It slips into place but is removable to allow adjustment and maintenance of the pulleys and the related rigging.

Rigging

Rigging of the ladder with the cable is best understood by starting with FIG. 10 which is a drawing showing a view on the right side of the ladder. The discussion that follows applies equally well to the left side. We start by attaching the Crimp Fitting 63 to the end of the Right Cable 26. This is accomplished by using a crimping tool and results in a strong and secure termination for the cable. The Right Cable 26 is then fed up thru the Tang 54 and then looped over the top of the Right Upper Pulley 80 as depicted in FIG. 15 and then down and around the Right Lower Pulley 22 as depicted in FIG. 3B and finally attaching to the Front Spool 36 shown in FIG. 5. As mentioned above the rigging on the left is the same.

Position Extremes

The Platform Assembly 7 can be moved by the operator through a wide range of positions. Some representative extremes are shown in FIG. 18, FIG. 19 and FIG. 20. FIG. 21 shows the ladder with the Rear Support Assembly 3 folded.

I claim:

1. An electric ladder comprising:

a ladder frame having a left tube and a right tube, said left and right tubes having upper and lower portions, said left and right tubes having a slot runs between the upper and lower portions, said upper portions of the left and right tubes coupled by a top bar and said lower portions of the left and right tubes coupled by a base;

said ladder frame further comprising a support assembly, said support assembly pivotally connected at the top portions of the left and right tubes, said support assembly being U-shaped having parallel first and second legs linked by a horizontal support;

said base comprising, a removable base cover, a left support plate and a right support plate, said left and right support plates bonded to respective ends of the base plate, a battery, a DC motor, front and back spool supports mounted by a respective support nut and electronic control box, a left pulley mount is coupled to the left support plate and right pulley mount is couple to the right support plate, a right pulley coupled to a right pulley mount, a left pulley coupled to a left pulley mount by a lower pulley retainer, a left cable guided by the left pulley and a right cable guided by the right pulley, the right and left cable are spooled onto a spool subassembly, the spool assembly comprises front and rear spools, a worm and worm gear, square drive shaft;

a platform assembly for carrying an operator, said platform assembly comprising a platform, a break unit, right and left roller guides mounted to a bottom side of the platform, a gate, latch pin, and a U-shaped security tube;

a right middle subassembly, comprising a right mounting plate, having upper and lower wheels coupled to an outer surface of the right mounting plate, an adjuster plate coupled to an inner surface of the right mounting plate, a tang welded to an outer surface of the right mounting plate, wherein the tang is inserted into the slot of the right tube; and wherein said right cable is fed through the tang allowing the platform to move up and down along the tubes;

a left middle subassembly, said left middle subassembly comprising a left mounting plate, having upper and lower wheels coupled to an outer surface of the left mounting plate, an adjuster plate coupled to an inner surface of the left mounting plate, a slide roller consisting of a plurality of roller pins positioned on an inner surface of the adjuster plate, said upper and lower wheels of said right and left middle subassemblies ride along the right and left tubes, said slide roller of the right middle and left middle subassemblies are held together and move as one unit when the platform assembly is positioned between the right and left middle subassemblies; and a brake unit, comprising a brake pedal, brake nut, brake pad, elastomeric pad.

* * * * *